US005323853A

United States Patent [19]

Leismer et al.

[11] Patent Number: 5,323,853

[45] Date of Patent: Jun. 28, 1994

[54] EMERGENCY DOWNHOLE DISCONNECT TOOL

[75] Inventors: Dwayne D. Leismer, Pearland; Margarete C. Wong, Houston, both of Tex.

[73] Assignee: Camco International Inc., Houston, Tex.

[21] Appl. No.: 49,380

[22] Filed: Apr. 21, 1993

[51] Int. Cl.[5] ..... E21B 23/00

[52] U.S. Cl. ..... 166/55; 166/377

[58] Field of Search ..... 166/55, 65.1, 373–375, 166/377, 381, 385

[56] References Cited

U.S. PATENT DOCUMENTS

| | | | |
|---|---|---|---|
| 4,375,237 | 3/1983 | Churchman | 166/381 X |
| 4,535,842 | 8/1985 | Ross | 166/123 X |
| 5,050,682 | 9/1991 | Huber et al. | 166/377 |
| 5,133,412 | 7/1992 | Coronado | 166/123 X |
| 5,257,663 | 11/1993 | Pringle et al. | 166/377 X |

*Primary Examiner*—Thuy M. Bui

*Attorney, Agent, or Firm*—Fulbright & Jaworski

[57] ABSTRACT

An emergency downhole disconnect tool for use in a drilling well conduit having hydraulic pressure activated and electricity activated means for disconnecting the tool from the drilling assembly by disconnecting telescoping first and second releasably connected parts.

13 Claims, 5 Drawing Sheets

EMERGENCY DOWNHOLE DISCONNECT TOOL

BACKGROUND OF THE INVENTION

The present invention is directed to an emergency disconnect tool for use in a well drilling conduit for use in the event the drilling assembly becomes stuck.

While drilling wells, it is possible that the drilling assembly may become struck downhole. Simply pulling the drill string from the surface may be insufficient to free the drilling assembly, particularly in drilling operations and more particularly in horizontal drilling operations involving coiled tubing. Simply pulling the drill string from the surface can cause unpredictable tensile failure of the drill string due to the uncontrolled location or force required to part the tubing, resulting in expensive loss of equipment and abandonment of the well.

To overcome the problem of removing stuck drilling assemblies, various shear devices, such as disclosed in U.S. Pat. No. 5,070,941, have been proposed or used to internally shear the drill string.

In particular, typical coil tubing drilling applications use a hydraulic control line and an electric cable inside the coil tubing to actuate a lower drilling assembly such as disclosed in copending patent application Ser. No. 07/963,864, filed Oct. 20, 1992.

The present invention is directed to an improved disconnect tool which may use either the hydraulic control line and/or the electrical cable to disconnect the tool and which separate the control line and the electrical cable at a desired location.

SUMMARY OF THE INVENTION

It is an object of the present invention to provide an emergency disconnect tool actuated by simply applying a predetermined hydraulic pressure from the surface.

It is a further object of the invention to provide an emergency disconnect tool having redundant hydraulic and electrical releasing mechanisms.

It is a further object of the present invention to provide an emergency disconnect tool having a hydraulic control line and/or an electric cable extending therethrough in which the control line and cable are parted below a latching recess in the tool.

To achieve the foregoing objects, there is disclosed an emergency downhole well disconnect tool for use in a well conduit comprising a housing having first and second parts, said parts having first ends which telescopically coact with each other, said parts each having a second end adapted to be connected in a well conduit; coacting releasable locking means on the first and second parts for releasably locking the first and second parts together; actuating means in the housing for releasing the locking means upon hydraulic actuation; a hydraulic fluid passageway in the housing adapted to be connected to the well surface for receiving hydraulic fluid, and hydraulic blocking means between the passageway and the actuating means initially preventing hydraulic fluid from actuating the actuating means.

Also to achieve the foregoing objects there is disclosed an embodiment of the invention wherein the hydraulic fluid blocking means communicates hydraulic fluid to the actuating means upon a predetermined pressure in the hydraulic fluid in the passageway. In the preferred embodiment, the hydraulic fluid blocking means includes a rupture disk.

Also to achieve the foregoing objects there is disclosed an embodiment of the invention wherein the second part includes a pulling recess and the hydraulic fluid passageway includes a hydraulic line extending through the inside of the housing with a longitudinal slidable releasable joint positioned below the recess for separating when the first and second parts are disconnected from each other.

Also to achieve the foregoing objects there is disclosed an embodiment of the invention wherein an electrical line extends through the inside of the housing and the first and second parts include coacting shear means positioned below the recess for engaging and shearing the electrical line below the recess when the first and second parts are disconnected from each other.

Also to achieve the foregoing objects, there is disclosed the provision of an emergency downhole well disconnect tool which includes electrically actuated means in the housing engaging releasable locking means for releasing the locking means to allow separation of the first and second parts, and an electrical line in the housing adapted to be connected to the well surface and connected to the electrically actuated means.

Also to achieve the foregoing objects, there is disclosed a redundant emergency downhole well disconnect tool for use in a well conduit comprising a housing having first and second parts, said parts having first ends which telescopically coact with each other, said parts each having a second end adapted to be connected in a well conduit; coacting releasable locking means on the first and second parts for releasably locking the first and second parts together; actuating means in the housing for releasing the locking means upon hydraulic actuation; a hydraulic fluid passageway in the housing adapted to be connected to the well surface for receiving hydraulic fluid and for communicating with the actuating means; an electrically actuated means in the housing engaging the releasable locking means for releasing the locking means; and an electrical line in the housing adapted to be connected to the well surface and connected to the electrically actuated means.

DETAILED DESCRIPTION OF THE DRAWINGS AND PREFERRED EMBODIMENT

While the present invention is particularly useful when drilling with coil tubing, it may also be used in other types of drilling strings, and while the present disconnect will be described as preferably using a redundant hydraulic and electrical actuation, only one type of actuation need be provided.

Figure 1A:
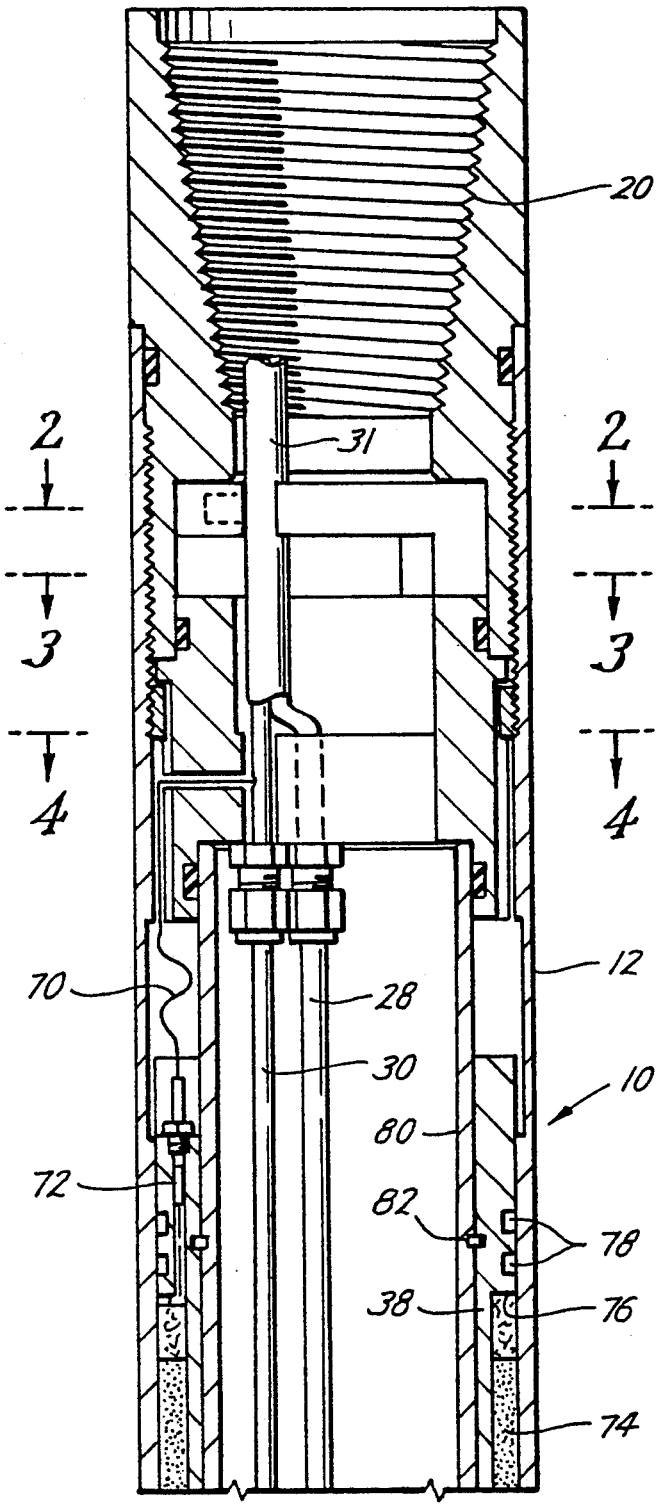
FIGS. 1A, 1B, 1C are continuations of each other and form an elevational view in cross section of the preferred embodiment of the invention.
Figure 1B:
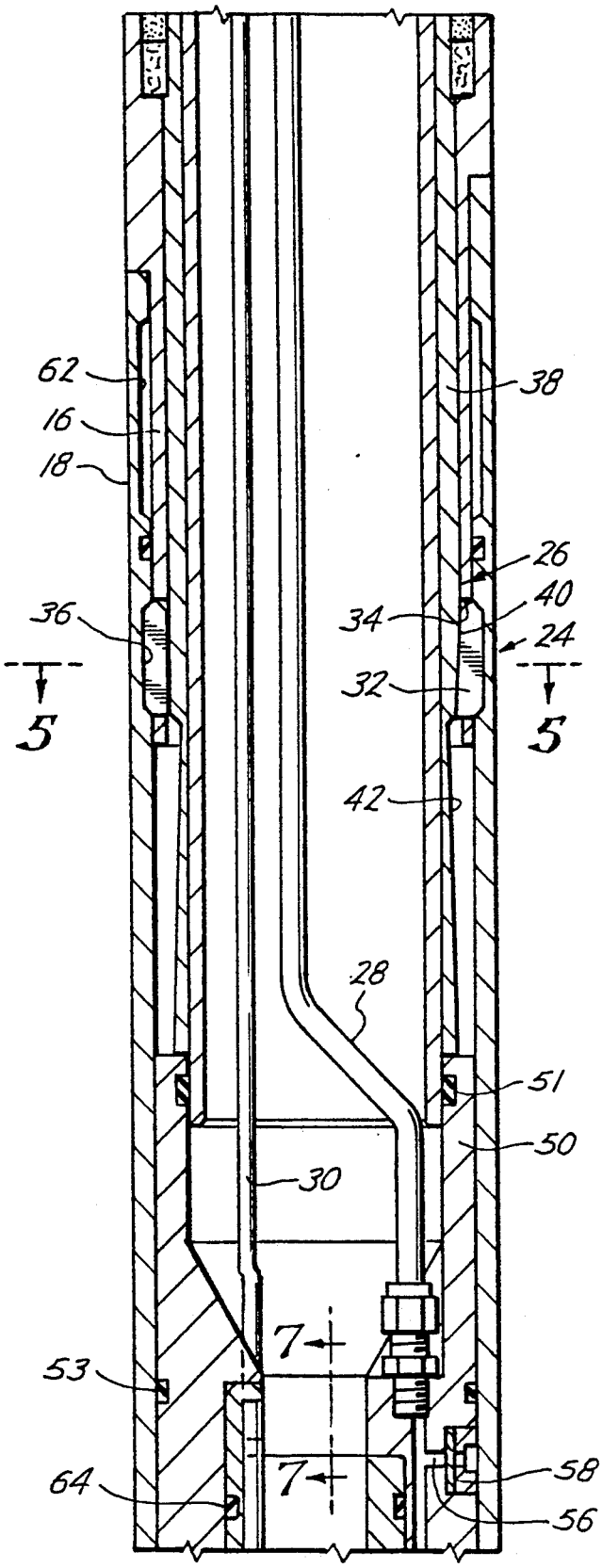
Figure 1C:
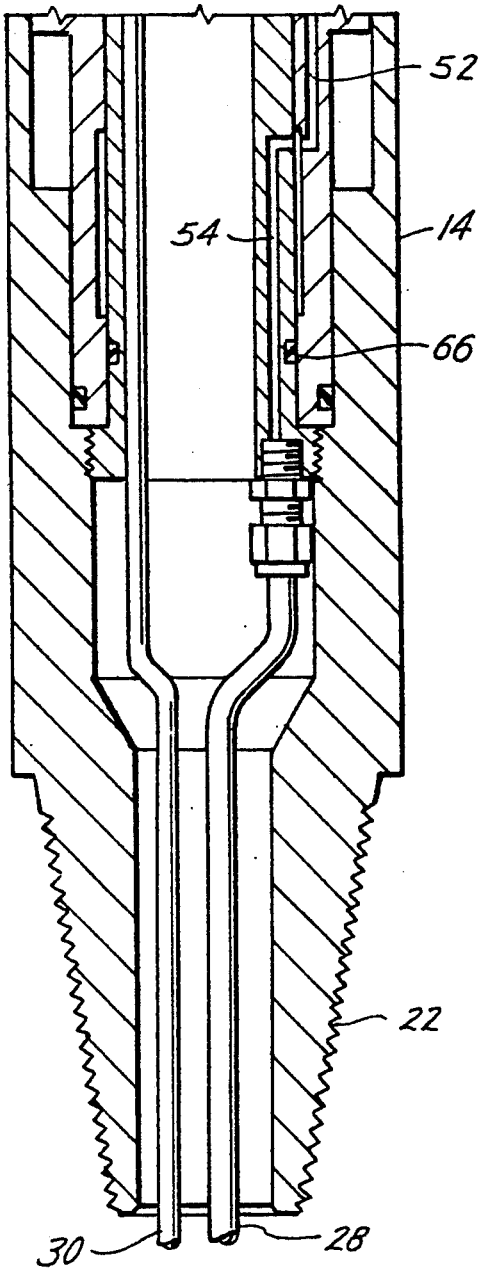
Figure 2:
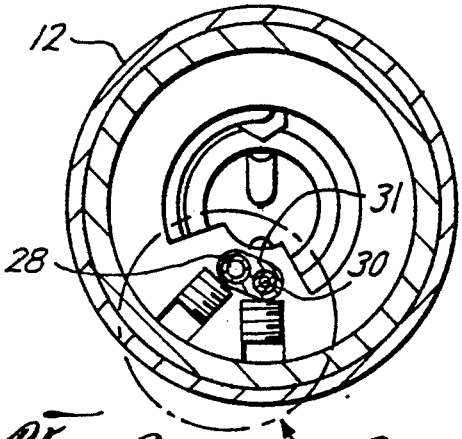
FIG. 2 is a cross-sectional view of FIG. 1A along the lines 2—2.
Figure 5:
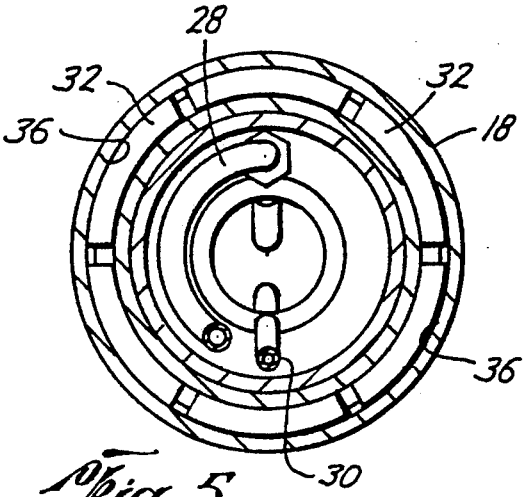
FIG. 5 is a cross-sectional view of FIG. 1B along the lines 5—5.
Figure 3:
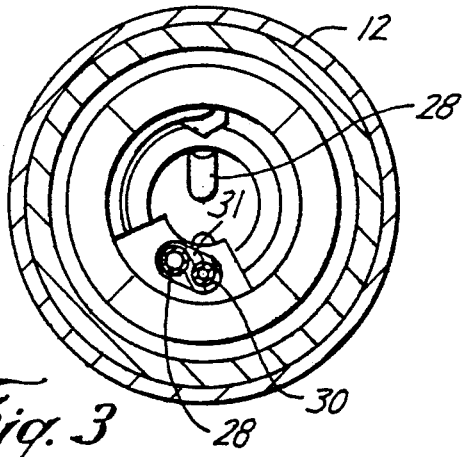
FIG. 3 is a cross-sectional view of FIG. 1A along the lines 3—3.
Figure 6:
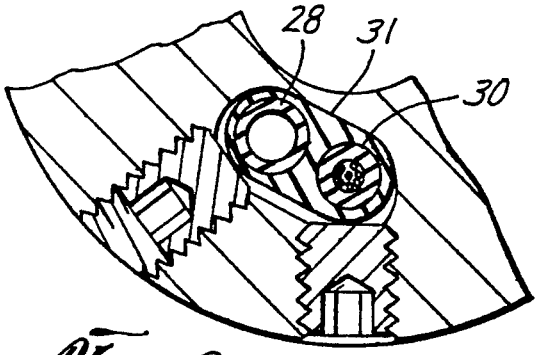
FIG. 6 is the detail indicated in FIG. 2.
Figure 4:
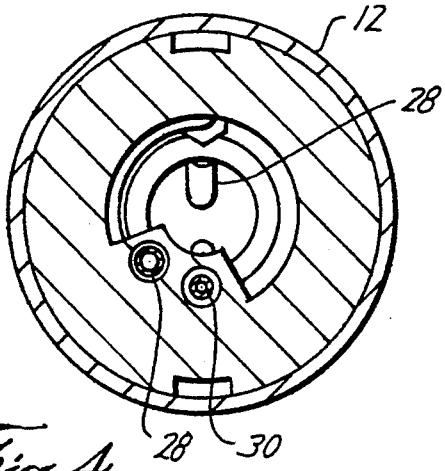
FIG. 4 is a cross-sectional view of FIG. 1A along the lines 2—2.

Referring now to the drawings, particularly to FIGS. 1A, 1B, and 1C, the reference numeral 10 generally indicates the emergency downhole well disconnect tool of the present invention and includes an upper housing or first part 12 and a lower housing or second part 14. The parts 12 and 14 include first ends 16 and 18, respectively, which telescopically coact with each other. Said parts 12 and 14 each have second ends 20 and 22, respectively, such as threaded connections which are adapted to be connected in a well conduit such as coil tubing. Coacting releasable locking means, generally indicated by the reference numeral 24 are provided on the first and second parts 12 and 14 for releasably locking the first and second parts 12 and 14 together. Actuating means generally indicated by the reference numeral 26 is provided for releasing the locking means 24 upon actuation. In addition, a hydraulic control line 28 and an electrical line 30 extend through the inside of the disconnect tool 10. For convenience, the hydraulic control line 28 and the electrical line 30 may be formed initially in a single cable 31 (FIGS. 2 and 6) and separated in part 12.

Referring to FIGS. 1B, 5, 8B and 9A, the coacting releasable locking means 24 is best seen and preferably includes a plurality of dogs 32 carried in windows 34 in the first part 12. The second part 18 includes a locking notch 36 for receiving the dogs 32. The actuating means 26 includes a sleeve 38 having a backup shoulder 40 which may be positioned to engage the dogs 32 and lock them in the locking notch 36 for releasably locking the first part 12 to the second part 14. The sleeve 38 includes a recess 42 which when moved in alignment with the dogs 32 allows the dogs to retract from the locking notch 36 for releasing the locking means 24.

Figure 8A:
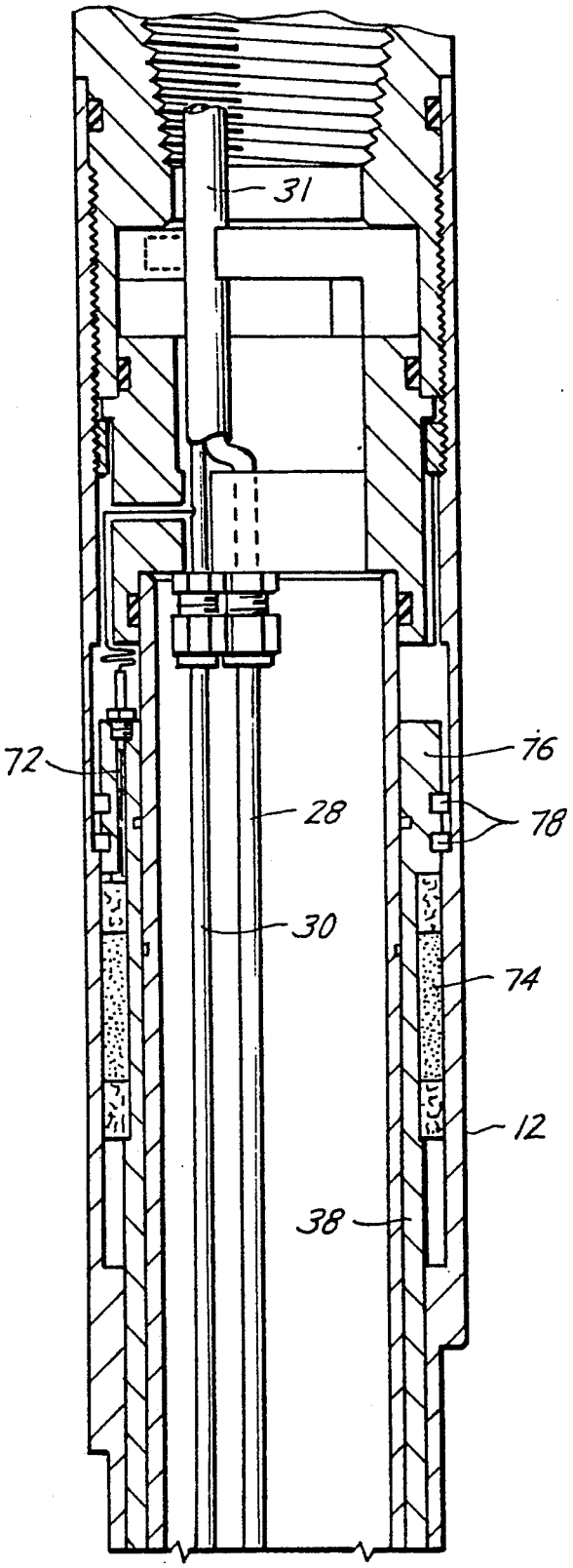
FIGS. 8A and 8B are continuations of each other and form an elevational view in cross section of the upper housing part of the invention.
Figure 8B:
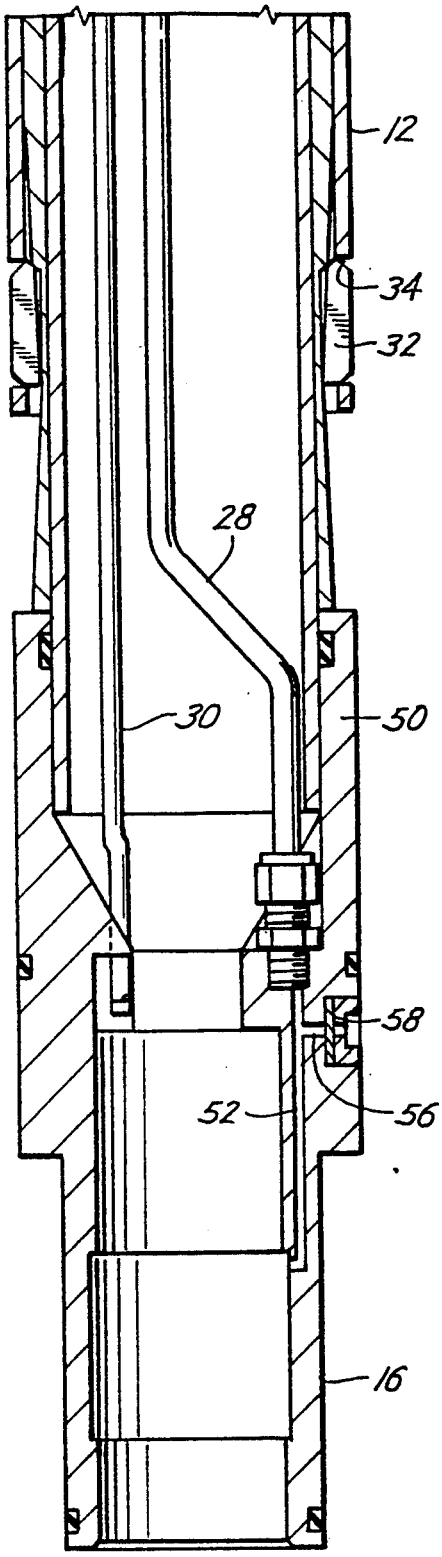
Figure 9A:
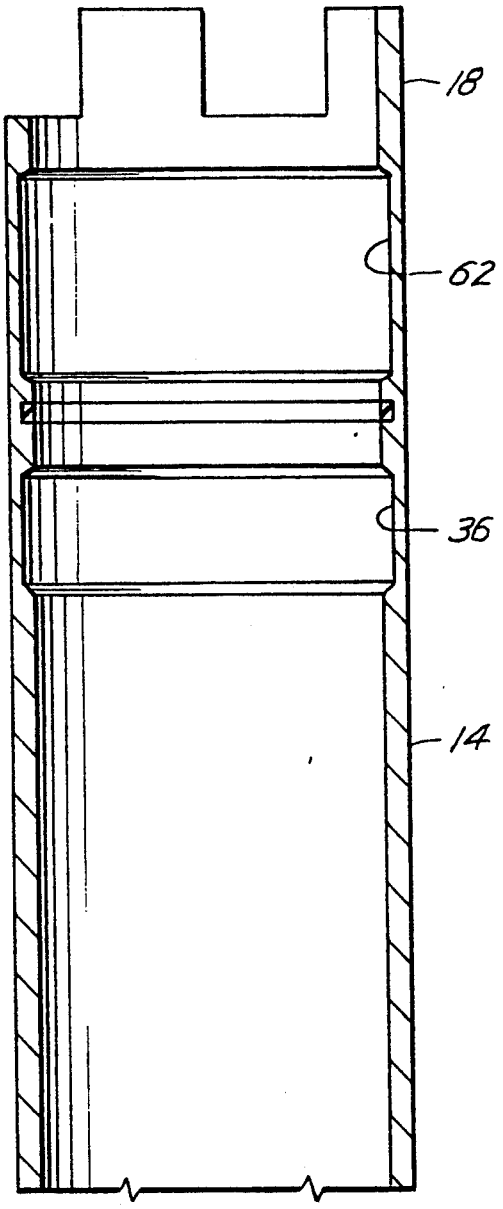
FIGS. 9A and 9B are continuations of each other and form an elevational view in cross section of the lower housing part of the invention.
Figure 9B:
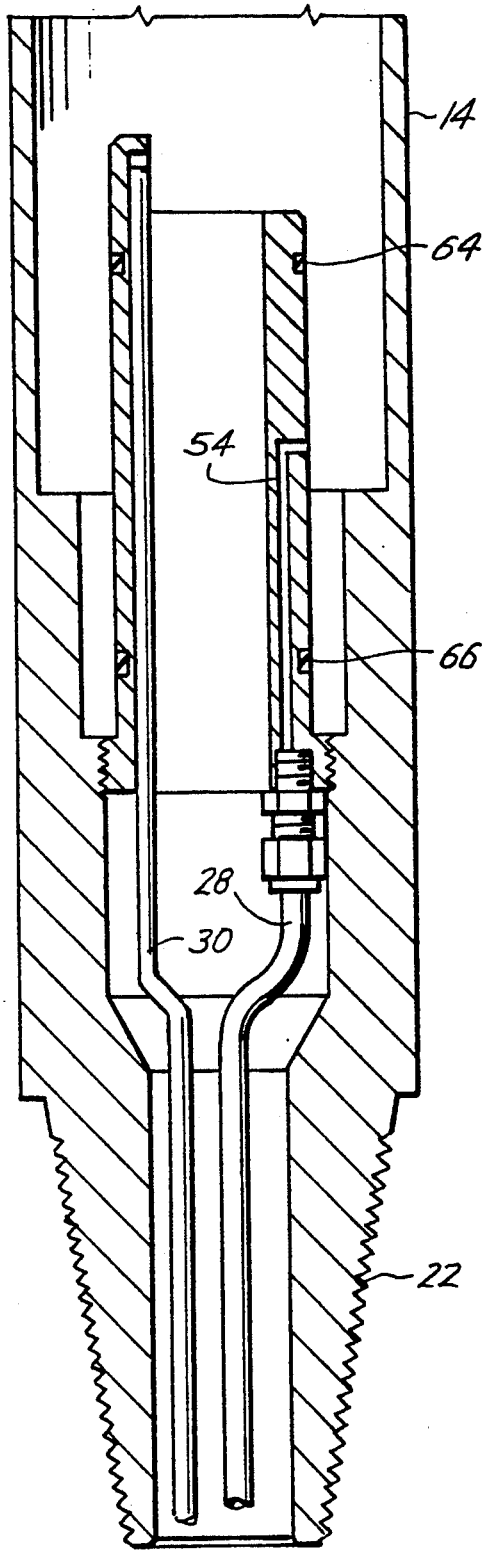

The actuating means 26 may include one or more releasing mechanisms. Referring now to FIGS. 1B, 8B, and 9B the actuating means may include a hydraulic piston 50 subject to hydraulic actuation. While the piston 50 may be actuated by hydraulic actuation of fluid in the bore of the tool 10, it is preferable to communicate and actuate the piston 50 from hydraulic fluid in the control line 28. The hydraulic control line 28 includes a fluid passageway 52 in the upper part 12 and a passageway 54 in the lower part 14. In addition, a fluid passageway 56 (FIGS. 1B and 8B) extends from passageway 52 to a hydraulic fluid blocking means 58 such as rupture disk, although other suitable means such as valving could be used. The rupture disk 58 is designed to rupture upon a predetermined hydraulic pressure at some predetermined value above the hydraulic operating pressure of the downhole drilling assembly thereby applying hydraulic fluid across the piston 50 by acting upon piston seals 51 and 53. hydraulic actuation of the piston 50 upwardly moves the sleeve 38 upwardly thereby moving the locking shoulder 40 from behind the dogs 32 and aligning the recess 42 with the locking dogs 32 thereby releasing tool parts 12 and 14. This allows the parts 12 and 14 to be telescopically separated by pulling upon a well conduit connected to end 20 of the upper part 12.

Referring now to FIGS. 1C, 8B and 9B, it is to be noted that initially the fluid passageway 52 and 54 are in fluid communication when the parts 12 and 14 are assembled. However, on disconnecting parts 12 and 14 the passageways 52 and 54 form a longitudinally slidable releasable joint which is positioned below a fishing recess 62 (FIGS. 1B and 9A) in the lower part 14. This insures that the hydraulic control line 28 is parted below the latching recess 62 so as not to interfere with any subsequent fishing operations to retrieve the lower part 14 in any drilling assembly connected therebelow. Seals 64 and 66 are provided for sealing between the telescoping parts 12 and 14 for providing sealing engagement between the passageways 52 and 54.

In addition to hydraulically releasing the disconnect tool 10, the tool may also be disconnected electrically. One electrical line is utilized from the multi-conductor cable 30 for electrically actuating means in the tool 10 for engaging the releasable locking means 26 (FIG. 1B) for releasing the locking means 24. For example, the electrical line 70 (FIG. 1A) may actuate a conventional detonator 72 which in turn detonates an explosive charge 74 which acts on the actuating means 26 which may include a second piston 76 which has wipers 78. As best seen in FIG. 1A, the sleeve 38 is connected to an inner mandrel 80 by a snap C-ring 82 which is sheared upon actuation of the actuating means 26. Other methods using an electrical signal for actuating the release mechanism may include a solenoid, a linear motor, or a thermal process. After actuation of the second piston 76, the sleeve 38 is moved upwardly releasing the locking dogs 32 and again the parts 12 and 14 may be separated.

Figure 7:
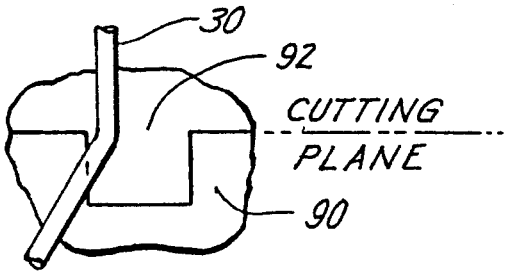
FIG. 7 is an elevational detail view of FIG. 1B along the lines 7—7.

However, it is also desirable to part the electrical cable 30 at a position below the fishing recess 62. Thus, as best seen in FIGS. 1B and 7, coacting shear means are provided on the first and second parts 12 and 14 which include coacting shears 90 and 92 positioned below the recess 62 for engaging and shearing the electrical line 30 when the first and second parts 12 and 14 are disconnected from each other.

In operation, the disconnect tool 10 may be separated by either hydraulic or electrical actuation. Hydraulic actuation is performed by pressuring the hydraulic control fluid in line 28 to a predetermined pressure (greater than the operating pressure of any drilling assembly therebelow) sufficient to overcome the rupture disk 58. Rupture of disk 58 allows hydraulic fluid to move piston 50 thereby moving sleeve 38 upwardly, shearing C-ring 82, moving the locking shoulder 40 from behind the dogs 32, and aligning recess 42 with dogs 32 thereby releasing tool parts 12 and 14. Parts 12 and 14 may be telescopically separated thereby cleanly separating the hydraulic line 28 and the electrical line 30 below latching recess 62.

The electric releasing mechanism is actuated by sending an electrical signal downhole over line 30 to line 70 to detonator 72 which detonates explosive charge 74 to move piston 78. Upward movement of piston 78 causes sleeve 38 upwardly to release locking dogs 32 and again the parts 12 and 14 may be separated.

What is claimed is:

1. An emergency downhole well disconnect tool for use in a well conduit comprising, a housing having first and second parts, said parts having first ends which telescopically coact with each other, said parts each having a second end adapted to be connected in a well conduit, coacting releasable locking means on the first and second parts for releasably locking the first and second parts together, actuating means in the housing for releasing the locking means upon hydraulic actuation, a hydraulic fluid passageway in the housing adapted to be connected to the well surface for receiving hydraulic fluid, and hydraulic blocking means between the passageway and the actuating means initially preventing hydraulic fluid from actuating the actuating means.

2. The disconnect tool of claim 1 wherein the hydraulic fluid blocking means communicates hydraulic fluid to actuating means upon a predetermined pressure on the hydraulic fluid in the passageway.

3. The disconnect tool of claim 2 wherein the hydraulic fluid blocking means includes a rupture disk.

4. The disconnect tool of claim 1 wherein the second part includes a pulling recess and said hydraulic fluid passageway includes a hydraulic line extending through the inside of the housing with a longitudinal slidable releasable joint positioned below the recess for separating when the first and second parts are disconnected from each other.

5. The disconnect tool of claim 1 including, an electrically actuated means in the housing engaging the releasable locking means for releasing the locking means, and an electrical line in the housing adapted to be connected to the well surface and connected to the electrically actuated means.

6. The disconnect tool of claim 5 wherein the second part includes a pulling recess and the electrical line extends through the inside of the housing and the first and second parts include coacting shear means positioned below the recess for engaging and shearing the line below the recess when the first and second parts are disconnected from each other.

7. A redundant emergency downhole well disconnect tool for use in a well conduit comprising, a housing having first and second parts, said parts having first ends which telescopically coact with each other, said parts each having a second end adapted to be connected in a well conduit, coacting releasable locking means on the first and second parts for releasably locking the first and second parts together, actuating means in the housing for releasing the locking means upon hydraulic actuation, a hydraulic fluid passageway in the housing adapted to be connected to the well surface for receiving hydraulic fluid and for communicating with the actuating means, an electrically actuated means in the housing engaging the releasable locking means for releasing the locking means, and an electrical line in the housing adapted to be connected to the well surface and connected to the electrically actuated means.

8. The disconnect tool of claim 7 including, hydraulic blocking means between the passageway and the actuating means initially preventing hydraulic fluid from actuating the actuating means.

9. The disconnect tool of claim 8 wherein the hydraulic fluid blocking means communicates hydraulic fluid to actuating means upon a predetermined pressure on the hydraulic fluid in the passageway.

10. The disconnect tool of claim 9 wherein the hydraulic fluid blocking means includes a rupture disk.

11. The disconnect tool of claim 7 wherein the second part includes a pulling recess and said hydraulic fluid passageway includes a hydraulic line extending through the inside of the housing with a longitudinal slidable releasable joint positioned below the recess for separating when the first and second parts are disconnected from each other, and the electrical line extends through the inside of the housing and the first and second parts include coacting shear means positioned below the recess for engaging and shearing the line below the recess when the first and second parts are disconnected from each other.

12. An emergency downhole well disconnect tool for use in a well conduit comprising, a housing having first and second parts, said parts having first ends which telescopically coact with each other, said parts each having a second end adapted to be connected in a well conduit, coacting releasable locking means on the first and second parts for releasably locking the first and second parts together, an electrically actuated means in the housing engaging the releasable locking means for releasing the locking means, and an electrical line in the housing adapted to be connected to the well surface and connected to the electrically actuated means.

13. The disconnect tool of claim 2 wherein the second part includes a pulling recess and the electrical line extends through the inside of the housing and the first and second parts include coacting shear means positioned below the recess for engaging and shearing the line below the recess when the first and second parts are disconnected from each other.

* * * * *

UNITED STATES PATENT AND TRADEMARK OFFICE

CERTIFICATE OF CORRECTION

PATENT NO. : 5,323,853

DATED : June 28, 1994

INVENTOR(S) : Leismer et al

It is certified that error appears in the above-indentified patent and that said Letters Patent is hereby corrected as shown below:

Column 3, line 57, change "hydraulic" to -- Hydraulic --

Column 6, line 46, change "2" to -- 12 --

Signed and Sealed this

Thirty-first Day of January, 1995

*Attest:*

*Attesting Officer*

BRUCE LEHMAN

*Commissioner of Patents and Trademarks*